United States Patent [19]

Miller

[11] Patent Number: 4,615,752

[45] Date of Patent: Oct. 7, 1986

[54] METHODS OF PUMPING AND LOADING EMULSION SLURRY BLASTING COMPOSITIONS

[75] Inventor: Kenneth A. Miller, West Jordan, Utah

[73] Assignee: IRECO Incorporated, Salt Lake City, Utah

[21] Appl. No.: 674,275

[22] Filed: Nov. 23, 1984

[51] Int. Cl.[4] ..... D03D 23/00

[52] U.S. Cl. ..... 149/108.8; 102/313; 149/109.6; 149/2; 137/13; 137/14

[58] Field of Search ..... 149/2, 109.6; 264/3 R; 86/20 C; 102/313; 137/13, 14, 888, 891, 896

[56] References Cited

U.S. PATENT DOCUMENTS

| | | | |
|---|---|---|---|
| 4,216,040 | 8/1980 | Sudweeks et al. | 149/46 |
| 4,273,147 | 6/1981 | Olney | 149/108.8 |
| 4,344,752 | 8/1982 | Gallagher | 137/896 |
| 4,416,610 | 11/1983 | Gallagher | 137/888 |
| 4,462,429 | 7/1984 | Coursen | 137/891 |
| 4,491,489 | 1/1985 | Ellis et al. | 264/3 |
| 4,510,958 | 4/1985 | Coursen | 137/13 |

*Primary Examiner*—Stephen J. Lechert, Jr.

[57] ABSTRACT

The invention relates to methods for refining, pumping and loading a borehole with a water-in-oil emulsion slurry blasting composition, wherein the emulsion slurry blasting composition is pumped or forced through a valve positioned at the end of a delivery hose in order to increase the viscosity of the composition prior to its expulsion from the hose.

13 Claims, 1 Drawing Figure

METHODS OF PUMPING AND LOADING EMULSION SLURRY BLASTING COMPOSITIONS

FIELD OF THE INVENTION

The present invention relates to a method for loading a borehole with a water-in-oil emulsion slurry blasting composition, a method of refining a water-in-oil emulsion slurry blasting composition, an improved method of pumping a water-in-oil emulsion slurry blasting composition through a delivery hose and a method of loading an upwardly extending borehole with a water-in-oil emulsion slurry blasting composition.

BACKGROUND OF THE INVENTION

Water-in-oil emulsion slurry blasting compositions are well-known in the art. See, for example, U.S. Pat. Nos. 3,161,551; 4,141,767; 4,216,040; 4,231,821; and 4,322,258. These compositions contain a continuous organic liquid fuel phase throughout which is dispersed droplets of an aqueous or aqueous-miscible inorganic oxidizer salt solution phase. With respect to the term "water-in-oil," any highly polar, hydrophilic liquid or melt falls into the "water" category and hydrophobic, nonpolar liquids are considered "oils." In contrast to slurry blasting compositions containing a continuous aqueous phase, which generally are thickened and cross-linked for desired viscosity and water-resistance, emulsion slurry blasting compositions do not require thickeners and cross-linkers for water resistance, since the external phase is water-immiscible and the viscosity of the emulsion slurry blasting composition can be varied by the degree of refinement of the dispersed or emulsified droplets of water-miscible phase or internal phase. Emulsion slurry blasting compositions have other advantageous properties as described in the above-referenced patents.

Emulsion slurries normally are fluid when initially formulated and thus are pumped from a mixing chamber into packages or boreholes. A major problem with handling emulsion slurries is the difficulty in pumping them at the relatively high viscosities required in certain applications. For example, emulsion slurries need to be viscous enough to resist running into cracks and fissures in boreholes, to resist erosional effects of dynamic water, or to resist gravitational flow when loaded into upwardly extending boreholes. Past efforts at handling relatively viscous emulsion slurries either required expensive, heavy duty pumps capable of producing high pressure heads, which pumps also may exert destructive forces on the stability of the emulsion or on its ingredients (such as hollow, spherical density reducing agents), or some type of lubricating system in the hose or delivery conduit, such as injecting an annular stream of liquid around the pumped emulsion slurry to lubricate its flow through the hose.

The present invention provides a method whereby emulsion slurries readily can be pumped through loading or delivery conduits or hoses at relatively low viscosities, but exit from the hose at the desired higher viscosities. This is accomplished by pumping the emulsion slurry through a valve positioned at or near the end of the delivery hose to impart shear to the composition and thereby increase its viscosity prior to its expulsion from the hose. In this fashion, thin, easily pumped emulsion slurry can be delivered through a hose at a relatively low pumping pressure. Upon exit from the hose, the emulsion slurry has a desired higher viscosity. Thus the use of high pumping pressures or additional lubricating systems can be avoided.

SUMMARY OF THE INVENTION

The present invention provides an improved method of pumping an emulsion slurry blasting composition through a delivery hose having at or near its end a valve which is adjusted to impart shear to the composition and thereby increase its viscosity prior to its expulsion from the hose. This allows the emulsion slurry to be easily pumped while thin or of relatively low viscosity but to be delivered into a borehole or container at a desired higher viscosity. The present invention also provides a method of refining an emulsion slurry, a method of loading a borehole with an emulsion slurry and a method of loading an upwardly extending borehole with an emulsion slurry, and these methods include the step of pumping or forcing the emulsion slurry through a valve positioned at or near the end of a delivery hose, which valve is adjusted to impart shear to the composition and thereby increase its viscosity prior to its expulsion from the hose. The methods of the present invention also can be employed with a method of lubricating the flow of the emulsion slurry through the hose, if desired, as is more fully explained herein.

DETAILED DESCRIPTION OF THE INVENTION

Figure 1:
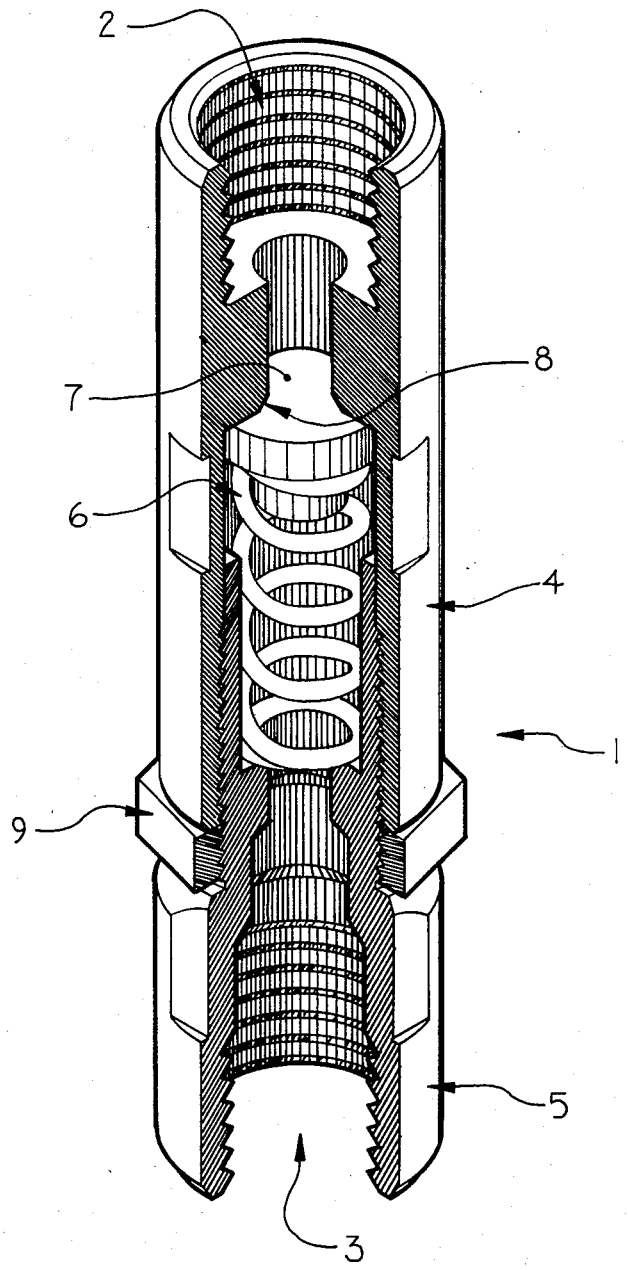
FIG. 1 is a cross-sectional perspective view of a spring-loaded valve.

The methods of the present invention relate to increasing the viscosity of an emulsion slurry at or near the end of a delivery hose, in order that the slurry can exit from the hose at a higher viscosity than when pumped through the hose. This is accomplished by pumping or forcing the emulsion slurry through a valve which is adjusted to impart shear to the composition and thereby increase its viscosity. It is observed that the additional refinement of the emulsion slurry caused by the shearing action of the valve reduces the droplet size and increases the number of the dispersed water-miscible droplets, and this increased number of droplets increases the viscosity of the slurry.

As used herein, the term "valve" means any device capable of imparting shear to a flowing stream of emulsion slurry. The valve can be any of numerous mechanical devices by which the flow of a liquid can be regulated by a part that obstructs and preferably adjustably obstructs the passage of the liquid. The purpose of the valve is to create a high velocity emulsion slurry stream through a small orifice, thereby imparting shear to the emulsion slurry resulting in further refinement of the emulsion slurry and thus increased viscosity. Simple, commonly used valves may be employed, such as ball, spring-loaded or gate valves.

FIG. 1 shows a preferred, spring-loaded valve 1 of the present invention. The cylindrical valve 1 is threaded on in-flow end 2 and out-flow end 3 for threadably engaging a delivery hose (not shown). Casing 4 and adjusting screw 5 of the valve are threadably engaged for adjustably varying the compression on spring 6 and thus the resistive force of valve seat 7 against port 8. Lock nut 9 secures adjusting screw 5 in place and is threadably engaged to adjusting screw 5. By screwing adjusting screw 5 into casing 4, spring 6 is increasingly compressed thereby causing valve seat 8 to resist more forcefully the flow of emulsion slurry through the valve and thus create a smaller orifice through which the emulsion slurry flows. This reduced orifice imparts increased shear to the emulsion slurry as it passes through the valve thereby increasing the emulsion slurry's viscosity.

The valve is located at or near the end of the delivery hose to minimize the distance through which a viscous emulsion slurry must be pumped. Thus the emulsion slurry is pumped through the delivery hose while it is thin and of relatively low viscosity, in order to accommodate relative low pumping pressures. As the emulsion slurry passes through the valve, its viscosity increases, and since the valve is positioned at or near the end of the hose, the more viscous emulsion slurry travels little if any distance before it is expelled from the hose, thereby accommodating low pumping pressures.

Additionally, a lubricating means can be employed with the methods of the present invention, if desired. In order to enhance further the ease of pumping the emulsion slurry through the delivery hose, an annular stream of a lubricating fluid, such as water, an aqueous solution of an organic or inorganic compound or compounds (for example an aqueous inorganic oxidizer salt solution such as described in U.S. Pat. No. 4,273,147) or an aqueous-miscible fluid can be injected into the hose and around the composition at a linear velocity substantially equal to that of the composition to lubricate its flow through the hose. Although such lubricating means is unnecessary, and in fact, the present invention provides methods to make such lubricating means unnecessary, the combination of the methods of the present invention with such lubricating means allows an ultimately more viscous emulsion slurry to be placed into boreholes or other containers.

When using the above-described lubricating means, the pumped emulsion slurry can be deficient in water or aqueous inorganic oxidizer salt solution until it reaches the valve in which at least part of the lubricating fluid then is mixed into and forms part of the emulsion slurry by the shearing action of the valve. Generally, from about 2% to about 10% by weight lubricating water or salt solution can be so added to the composition. With a level of 5% added water, little drop in actual energy output is seen; whereas at a level of 10% water, a sizable drop is experienced. Alternatively, the lubricating fluid could be allowed to escape prior to its entry into the valve.

The shearing action of the valve imparts additional advantages to the emulsion slurry. In addition to an increased viscosity, the reduced size of the dispersed water-miscible droplets may increase the emulsion slurry's stability and sensitivity to detonation. Thus the present invention also is a method for refining emulsion slurries to make them more stable and sensitive to detonation.

The present invention is more fully described in the examples given below.

EXAMPLE 1

An emulsion slurry was formulated by a standard procedure and was pumped through a spring-loaded valve which was adjusted for pressure drops of 10.5 kg/cm$^2$ and 17.5 kg/cm$^2$ (with the greater pressure drop reflecting a greater degree of shearing action or refinement). Viscosity increases through the valve and detonation results are as follows:

| Ingredients | % By Weight |
|---|---|
| Ammonium Nitrate (AN) | 67 |
| Calcium Nitrate[1] (CN) | 8 |
| Water | 16 |
| Emulsifier | 1.5 |
| Fuel Oil | 4.5 |
| Microballoons | 3.0 |
| | 100.0 |

| | 1 | 2 | 3 |
|---|---|---|---|
| Pressure Drop (kg/cm$^2$) | — | 10.5 | 17.5 |
| Viscosity (centipoise)[2] | 29920 | 83520 | 101920 |
| Density (g/cc at 5° C.) | 1.21 | — | 1.22 |
| Results at 5° C.[3] | | | |
| 72 mm (km/sec) | 4.8 | — | 4.7 |
| 32 mm (km/sec) | 4.5 | — | 4.4 |
| MB, 75 mm Det/Fail[4] | 8 g/12 | — | 8 g/12 |
| $d_c$, Det/Fail (mm)[6] | 32/25 (LOD) | — | 32/25 (LOD) |

[1]Fertilizer grade CN comprising 81:14:5 CN:$H_2O$:AN
[2]Taken with a Brookfield Viscometer, #7 spindle, 50 rpm, 25° C.
[3]The numbers represent detonation velocities in the charge diameters indicated
[4]MB = minimum booster (both 1 and 3 detonated with an 8 g pentolite booster and failed with a No. 12 cap)
[6]$d_c$ = critical diameter (both 1 and 3 had low order detonations (LOD) in 25 mm)

The above results illustrate the degree of viscosity increases resulting from subjecting the emulsion slurry to the shearing action of the valve. Further, the detonation results indicate that the slurry can experience a pressure drop of 17.5 kg/cm$^2$ psi and a three-fold increase in viscosity and retain at least comparable detonation properties.

EXAMPLE 2

The following emulsion slurry was formulated by a standard procedure:

| Ingredients | % By Weight |
|---|---|
| AN | 63.7 |
| Sodium Nitrate (SN) | 12.1 |
| Water | 15.7 |
| Oil | 5.0 |
| Emulsifier | 1.0 |
| Microballoons | 3.0 |

Four mixes of the above slurry were made. Mix 1 was simply the prepared formulation which had an initial viscosity of 22,400 centipoise (measured at 22° C. with a Brookfield viscometer, 50 rpm, #7 spindle). Mix 2 was processed at 36.4 kg/min through 26 meters of 25 mm diameter hose whose internal surface was lubricated with 2 to 3 percent water. At the end of the hose, the mix was forced through the valve shown in FIG. 1 at a backpressure of 21 kg/cm$^2$. The lubricating water was mixed into the formulation by the shearing action of the valve. Mix 2 had a final viscosity of 58,200 cps. Mixes 3 and 4 were forced through a ball valve and the valve of FIG. 1, respectively, but did not pass through a hose. They had respective viscosities of 70,400 cps (at a backpressure of 17.5 kg/cm$^2$) and 44,000 cps (at a backpressure of 10.5 kg/cm$^2$).

EXAMPLE 3

A ring of twelve 62.5 mm vertical boreholes ranging in depth from 4.3 to 18.5 m was loaded with emulsion slurry which was pumped through a 25 mm internal diameter loading hose that was pushed to the top of each borehole and gradually withdrawn as the borehole was loaded. From 3 to 6 percent lubricating water was introduced into the hose in the manner heretofore described. This lubrication allowed the slurry to be pumped through 37 m of hose at a pressure of only about 3.5 kg/cm$^2$. The slurry was forced through the valve shown in FIG. 1 which resulted in a viscosity increase sufficient to resist gravitational flow from the boreholes. The loaded boreholes were detonated successfully.

The methods of the present invention can be used in applications where it is desirable to deliver an emulsion slurry at a viscosity higher than the viscosity at which it is formulated or pumped. For example, the method has particular advantage for loading vertically extending boreholes in which the final product viscosity must be sufficient to resist gravitational flow, in order that the product once loaded will remain in the borehole. The methods also are useful in applications requiring lower pumping viscosities, such as when long loading hoses are being used. The methods further can be employed when it is desirable to refine further an emulsion slurry prior to its expulsion from a loading hose.

While the present invention has been described with reference to certain illustrative examples and preferred embodiments, various modifications will be apparent to those skilled in the art and any such modifications are intended to be within the scope of the invention as set forth in the appended claims.

What is claimed is:

1. An improved method of pumping a water-in-oil emulsion slurry blasting composition through a hose comprising the steps of pumping the composition through a hose having at or near its end a valve having an orifice smaller in cross-sectional area than that of the hose and pumping the composition through the valve which is adapted to impart a back-pressure to the composition of at least 10.5 kg/cm$^2$ and thereby increase its viscosity prior to its expulsion from the hose.

2. A method according to claim 1 comprising the additional step of injecting into the hose and around the composition an annular stream of a fluid at a linear velocity substantially equal to that of the composition to lubricate its flow through the hose.

3. A method according to claim 2 wherein the fluid is water or an aqueous inorganic oxidizer salt solution at least part of which is mixed into the composition by the shearing action of the valve.

4. A method according to claim 3 wherein the composition as pumped through the hose is deficient in water or aqueous inorganic oxidizer salt solution until mixed by the shearing action of the valve with the annular stream of water or salt solution.

5. A method according to claim 1 wherein the valve is a spring-loaded valve.

6. A method according to claim 1 wherein the valve is a ball valve.

7. A method of loading a borehole with a water-in-oil emulsion slurry blasting composition, which method includes the step of pumping the composition through a valve positioned at or near the end of a delivery hose, such valve having an orifice smaller in cross-sectional area than that of the hose, to impart shear to the composition and thereby increase its viscosity prior to its expulsion from the hose.

8. A method of loading an upwardly extending borehole with a water-in-oil emulsion slurry blasting composition comprising extending a delivery hose to or near the end of the borehole, pumping the composition through the hose and a valve positioned at or near the end of the hose, which valve has an orifice smaller in cross-sectional area than that of the hose and which is adapted to impart shear to the composition and thereby increase its viscosity to enable it to resist gravitational flow.

9. A method according to claim 8 comprising the additional step of injecting into the hose and around the composition an annular stream of a fluid at a linear velocity substantially equal to that of the composition to lubricate its flow through the hose.

10. A method according to claim 9 wherein the fluid is selected from the group consisting of water, an aqueousmiscible fluid and an aqueous inorganic oxidizer salt solution, at least part of which fluid is mixed into the composition by the shearing action of the valve.

11. A method according to claim 10 wherein the composition as pumped through the hose is deficient in water or aqueous inorganic oxidizer salt solution until mixed by the shearing action of the valve with the annular stream of water or salt solution.

12. A method according to claim 8 wherein the valve is a spring-loaded valve.

13. A method according to claim 8 wherein the valve is a ball valve.

* * * * *